United States Patent [19]

Gordon

[11] 4,085,864

[45] Apr. 25, 1978

[54] NEWSPAPER VENDING MACHINE

[75] Inventor: Roger G. Gordon, San Leandro, Calif.

[73] Assignee: Safe Rack, Inc., San Leandro, Calif.

[21] Appl. No.: 731,135

[22] Filed: Oct. 12, 1976

[51] Int. Cl.[2] ..... G07F 11/08

[52] U.S. Cl. ..... 221/155; 312/208; 221/215

[58] Field of Search ..... 221/155, 213, 214, 215, 221/216; 271/141; 312/208, 284

[56] References Cited

U.S. PATENT DOCUMENTS 1,528,778 3/1925 Millar, Jr. et al. ..... 221/215

3,351,172 11/1967 Hatanaka et al. ..... 221/155 X

*Primary Examiner*—Robert B. Reeves
*Assistant Examiner*—H. Grant Skaggs
*Attorney, Agent, or Firm*—Robert G. Slick

[57] ABSTRACT

A vending machine for newspapers or the like is provided having a single piece, clear cover which allows the merchandise to be viewed from various angles, which is easy to fill, and which protects the papers from exposure to the elements. The vending machine preferably incorporates an improved slide mechanism, making it substantially impossible to cheat the machine by obtaining more than one paper on a single operation of the slide release mechanism.

5 Claims, 11 Drawing Figures

NEWSPAPER VENDING MACHINE

SUMMARY OF THE INVENTION

The present invention relates to an improved newspaper vending machine and is particularly an improvement over the machine set forth in my U.S. Pat. No. 3,957,175 issued May 18, 1976.

Although the present invention is designated as a newspaper vending machine, it will be obvious that it can be used for vending any type of elongated, relatively flat article such as a magazine, box of merchandise, or the like.

The vending machine of the present invention has a single piece transparent plastic cover which extends over the top, both sides, and the front of the vending machine so that the papers are visible from a wide range of directions.

The cover of the present machine is preferably made of a single, formed piece of a transparent plastic so that the papers are fully protected from rain, dust, or the like.

The transparent cover used on the vending machine of the present invention in accordance with one embodiment is locked in place by the coin box mechanism so that one can remove the coin box and simultaneously release the cover so that only a single operation is necessary for retrieving the money from the previous day's sale and restocking the machine.

Various vending machines have been provided in the past wherein some form of slide mechanism is employed to dispense the merchandise, one unit at a time. A deficiency with such devices has been that by jiggling the slide mechanism one can get the machine to dispense two or even more articles each time the coins are inserted.

In accordance with the present invention, a slide mechanism is provided which is substantialy theft-proof so that if one attempts to jiggle the mechanism, or to remove an article before the slide is fully extended, the propelling means will drop away, effectively preventing the dispensing of a second article of merchandise.

The present invention includes a number of other features and advantages which will be brought out more fully in the balance of the specification.

DESCRIPTION OF THE PREFERRED EMBODIMENTS

Figure 1:
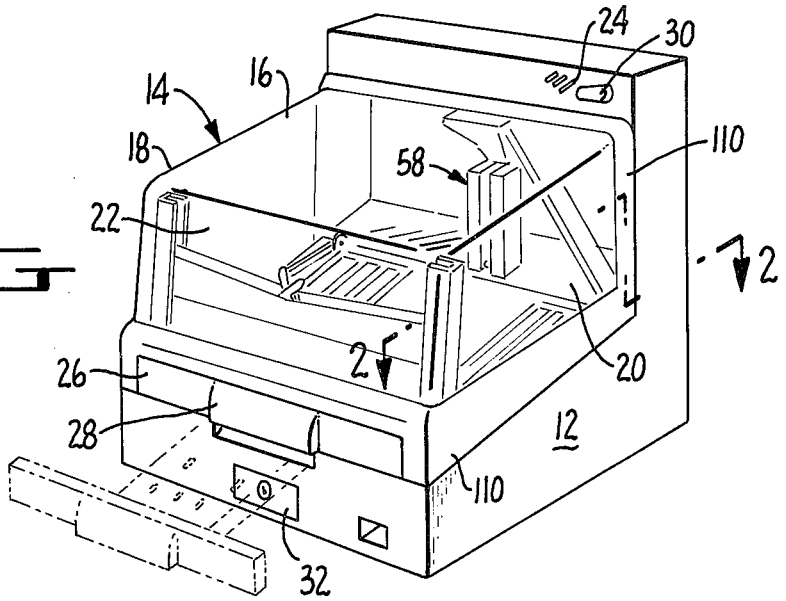
FIG. 1 is a perspective view of a vending machine embodying the present invention.
Figure 2:
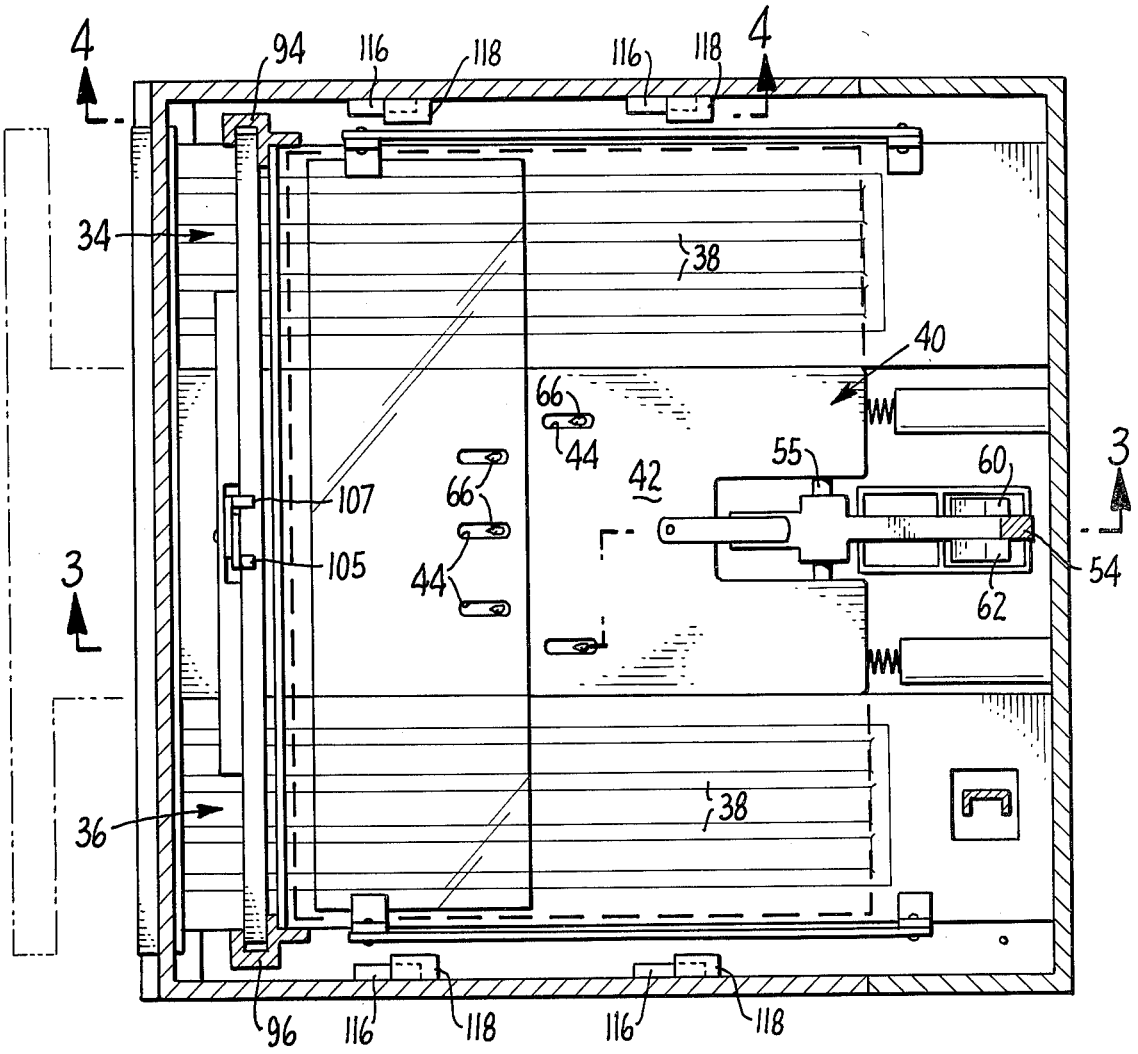
FIG. 2 is an enlarged section on the line 2—2 of FIG. 1.

Referring now to the drawings by reference characters, the machine of the present invention has a base 12 and a removable cover 14. The cover 14 has a top 16, sides 18 and 20, and a front 22 all formed of a single piece of transparent plastic and mounted on a frame 110, later described. Slots 24 are provided for the insertion of coins and a slide 26 having a handle portion 28 is provided at the front of the machine which is adapted to be slid forward, as is shown in phantom in FIG. 1, to dispense a paper when the correct coin(s) have been inserted in the slots 24. A return lever 30 is provided for the return of defective coins. A lockable coin box 32 is provided which serves the dual purpose, as is later explained in detail, of retaining coins and of unlocking the cover.

The operation of the vending machine is obvious in that one merely inserts the proper coin or coins in the slots 24 which releases an internal mechanism so that when one grasps the handle 28 and pulls outwardly, a single item is dispensed.

The novel slide mechanism will now be described in detail. Located within the cabinet 12 are fixed base members 34 and 36 which are preferably provided with glides 38 so that newspapers can slide over these base members easily. Located between the base members 34 and 36 is the movable slide member, generally designated 40. Slide member 40 has a planar, topsurface 42, with a plurality of slots 44 formed therein. The base member 40 includes sides 47 with out-turned lips or supports 46 and 48 which glide in grooves 50 and 52, respectively, formed in the down-turned edges 51 and 53 of the fixed members 34 and 36. The slide 40 has a detent 54 pivoted at 55 and held by compression spring 56. The detent 54 is normally engaged by a fixed catch 57 which is attached to the base of the machine. The detent 54 lies directly below the coin slot 58 and has cammed surfaces 60 and 62 on each side thereof, so if there is a proper combination of coins in the slot 58, one can pull forward on the slide handle 28 and the coin(s) will act on the cams, depressing the detent 54 and releasing it from catch 57. The coin mechanism itself forms no part of the present invention and is therefore not described.

Figure 5:
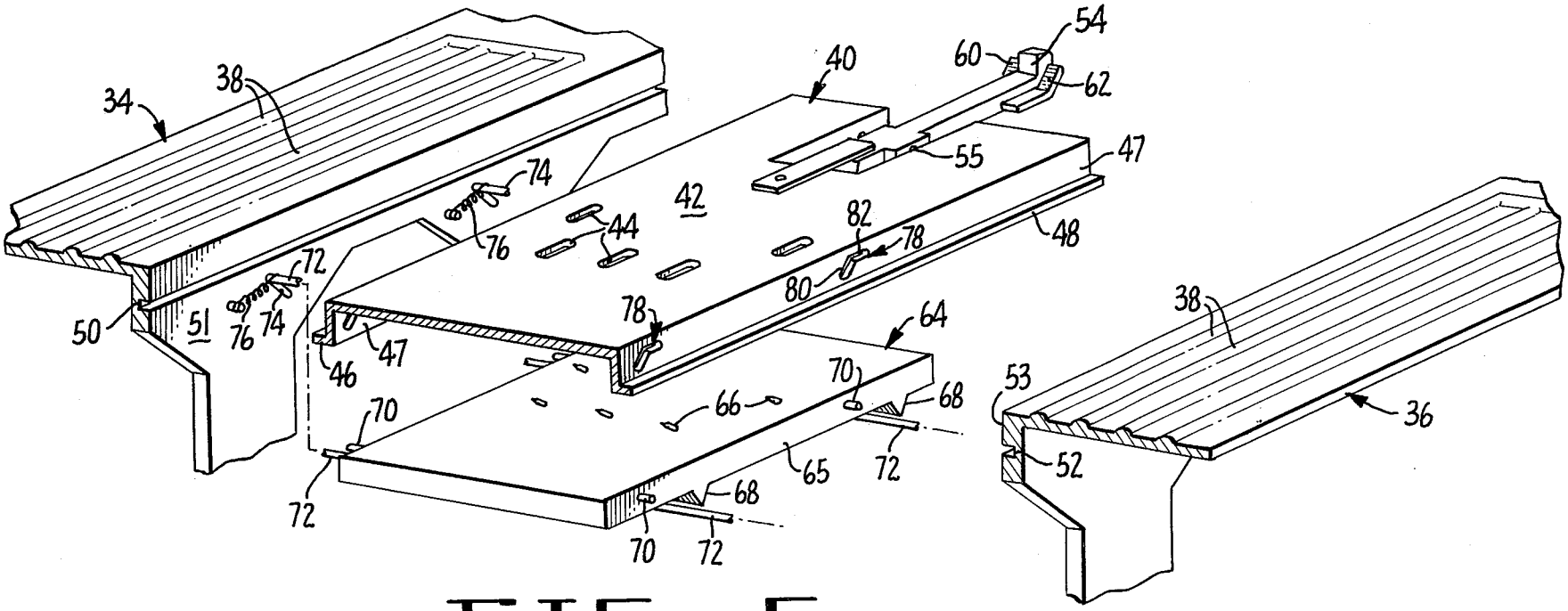
FIG. 5 is an exploded, perspective view of the novel slide mechanism used in the present invention.
Figure 6:
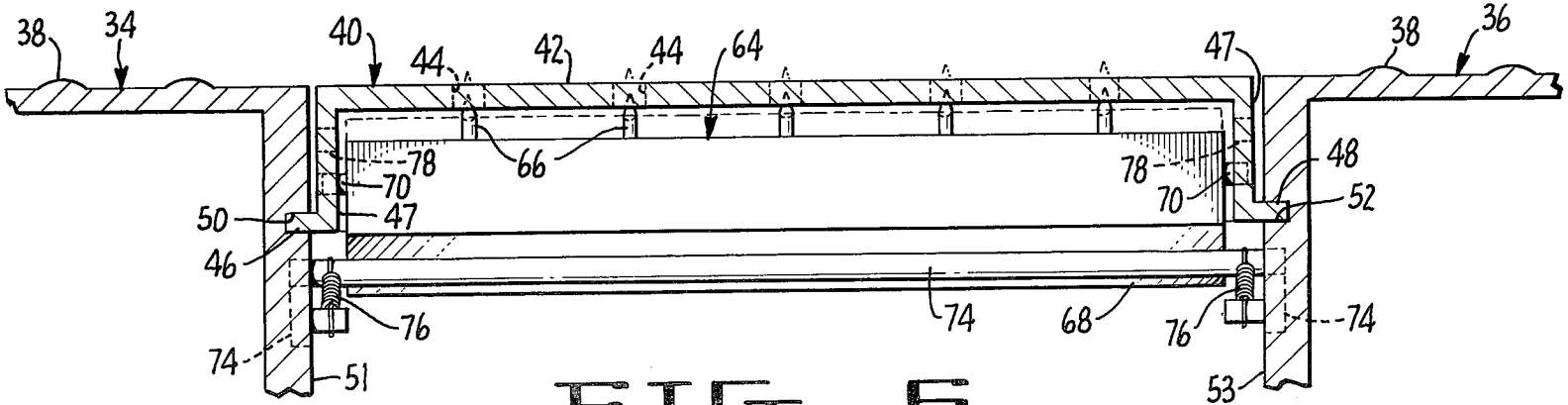
FIG. 6 is a section through the center of the slide mechanism.

Mounted under the slide 40 is a plate or member 64 which has a series of teeth 66 thereon which extend upwardly and toward the front of the machine at an angle of about 60°. The points 66 correspond in number and placement to the slots 44. Plate 64 has teeth or ridges 68 extending from side to side under the plate. The plate 64 is supported on plate 40 by pins 70 which extend outwardly from sides 71 of the plate 64 into slots 78 which are formed in the sides 47 of plate 40. Rods 72 extend under plate 64 into slots 74 formed in the down-turned edges 51 and 53. The slots extend toward the front of the machine at an angle of about 45°. The rods 72 are biased toward the front of the machine by springs 76. The shape of slots 78 is best seen in FIG. 5 and each consists of a lower portion 80 which angles toward the rear of the machine at an angle of about 45° and upper horizontal portion 82.

Figure 7:
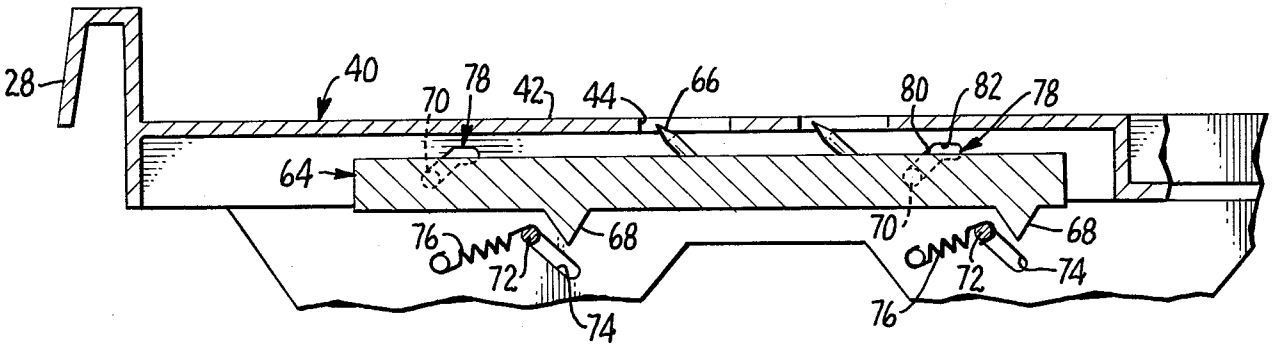
FIG. 7 is a side view of the slide mechanism showing the parts at rest, prior to a dispensing operation.
Figure 8:
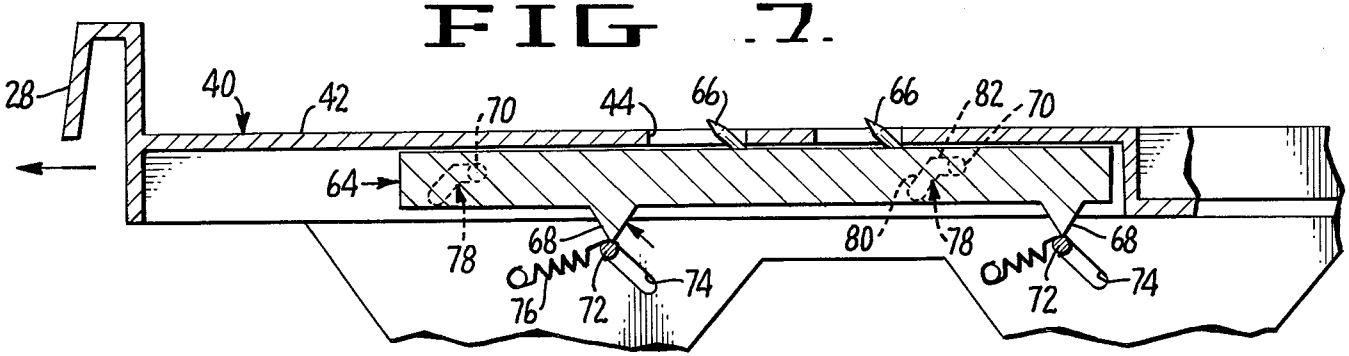
FIG. 8 is a view similar to FIG. 7, but showing the parts in the position which they assume during a dispensing operation.
Figure 9:
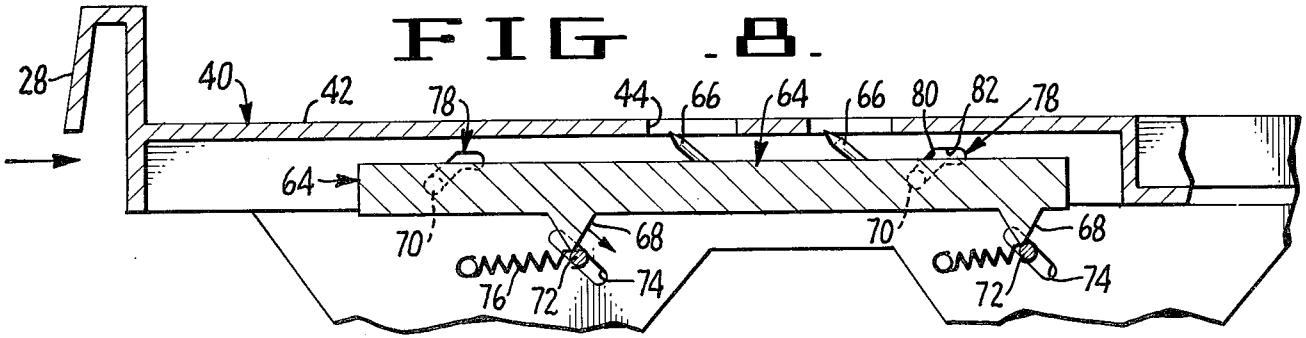
FIG. 9 is a similar view showing the motion of the parts when the slide is retracted.
Figure 10:
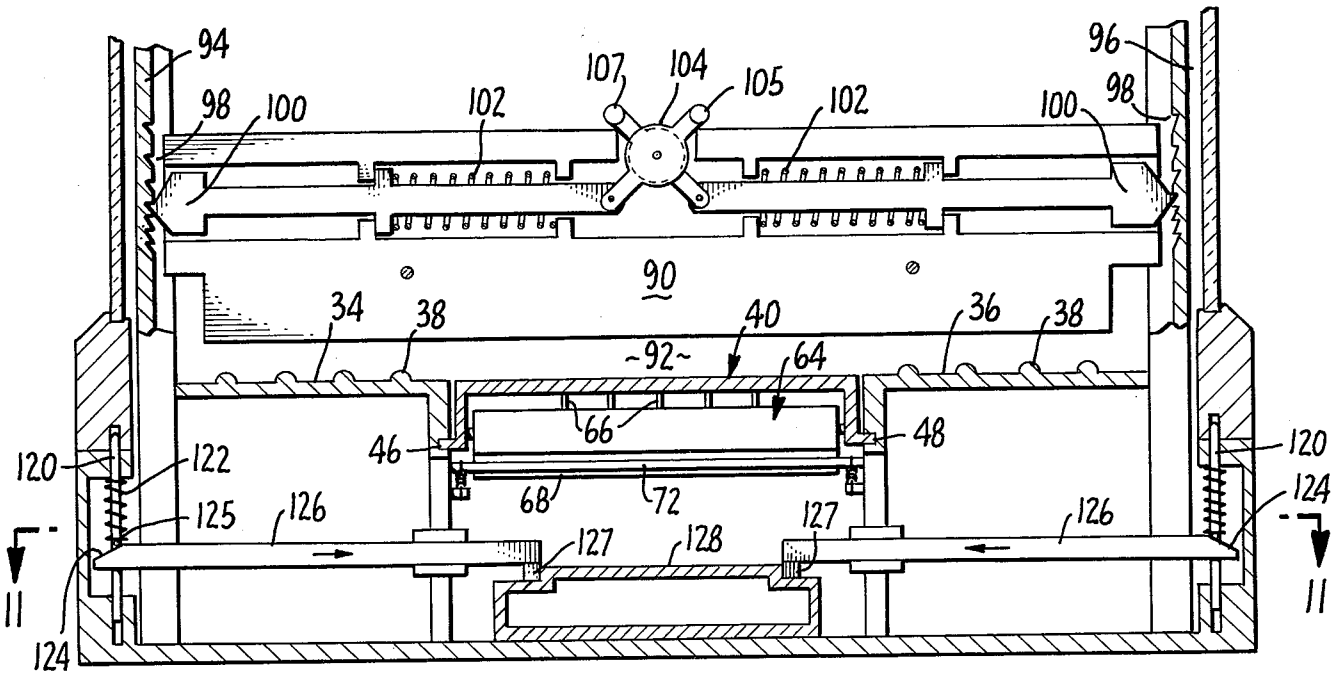
FIG. 10 is a section in elevation taken near the front of the machine.

The action of the slide mechanism is shown in FIGS. 7, 8 and 9.

As is shown in FIG. 7, the slide 40 is at its rearmost position and the plate 64 supported on pins 70 is at the lowest portion of the slots 78 so that pins 66 are retracted into the slots 44 and do not extend above the top surface 42 of plate 40. As the slide is now unlocked by the release of the detent 54, it can move forward as is shown in FIG. 8 and the forward movement causes the plate 64 to rise by the camming action of the angling portion 80 of the slots 78 combined with the retarding action of rods 72 on teeth 68, so that the pins 70 now come to rest in the horizontal portion 82 of the slots 78. The teeth 68 then slide over the rods 72 while the points 66 extend through the slots 44 and above the surface 42 of the slide 40. Thus, if an article is resting on the slide, it will be engaged by the points 66 and carried forward. So long as the slide is moving forward and the points 66 are engaged in an article, there will be no tendency for the points to fall back. However, if one should grasp a newspaper being held on the slide and pull it forward, the points 66 would be drug forward, causing the pins 70 to drop into the angling portion 80 of slots 78 so that continuing forward movement of the slide 40 would not result in another paper being dispensed since points 66 would be below surface 42. Accordingly, one could not pull the slide out part way, pull the paper off the slide, and then pull the slide all the way out to obtain a second paper. As a further precaution, as is best seen in FIG. 9, if one now tries to jiggle the slide by pushing it toward the rear of the machine, the teeth 68 will catch on the rods 72 so that the rearward motion will also pull down the plate 64.

As the slide 40 is pushed to its extreme rear position, the teeth 68 will depress and then ride over the rods 72, restoring the parts to the position shown in FIG. 7. Thus, it is impossible to obtain a second paper from the machine either by pulling the slide part-way out, removing a paper and then pulling the slide the rest of the way out, or, pulling the slide part-way out, removing a paper and then attempting to push the slide partially in to engage another paper. Thus, the machine is substantially theft-proof in its operation.

In order to dispense a single paper at a time, a movable gate 90 is provided near the front of the stack of papers. This gate is set at such a height that only one paper at a time will be dispensed through the slot 92 formed at the bottom thereof and, since the gate 90 is located at substantial distance back from the front wall of the machine, it is substantially impossible for one to reach in with the fingers and engage a second paper after one paper has been dispensed from the machine. The gate 90 rides in slots formed in members 94 and 96 which extend upwardly from the side members 34 and 36. These members have a series of teeth 98 at each side thereof. Gate 90 is provided with sliding detent members 100 which are urged outwardly by springs 102 into the teeth 98. The inner ends of detents 100 are attached to member 104 which has handles 105 and 107. By squeezing the handles 105 and 107 together, the detents are drawn in, allowing the gate to be adjusted to a desired height and, when the detent handles are released, the detents will be urged into engagement with the teeth 98, holding the gate at the desired location.

Figure 3:
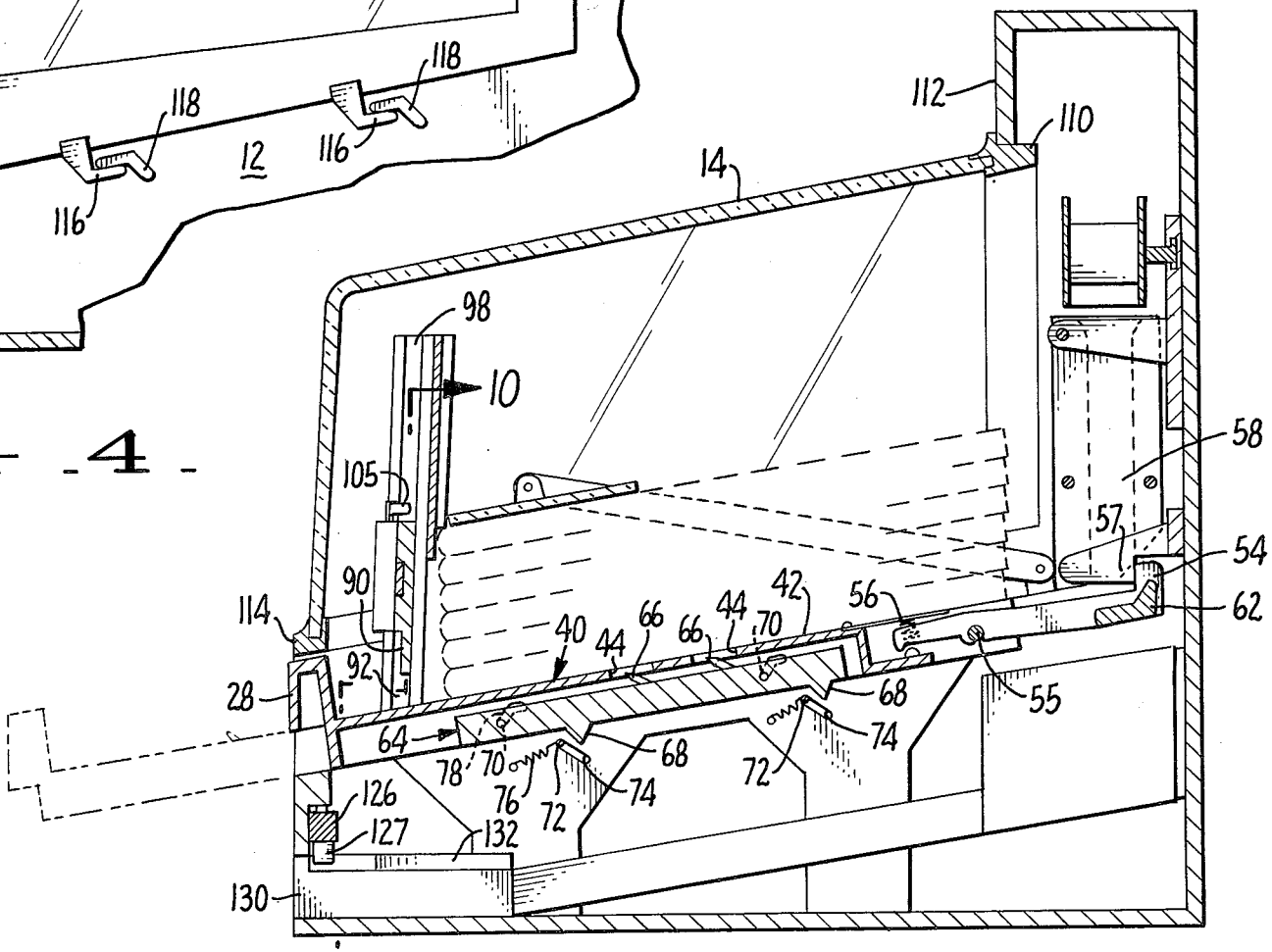
FIG. 3 is a section on the line 3—3 of FIG. 2.
Figure 4:
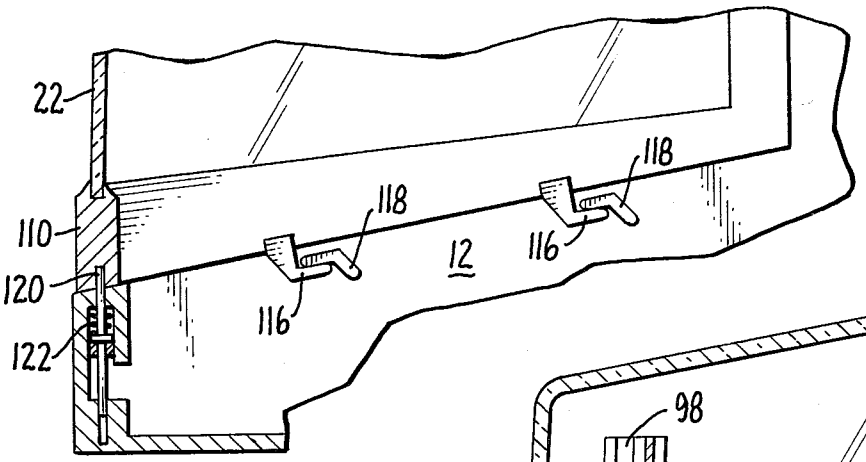
FIG. 4 is a section on the line 4—4 of FIG. 2.
Figure 11:
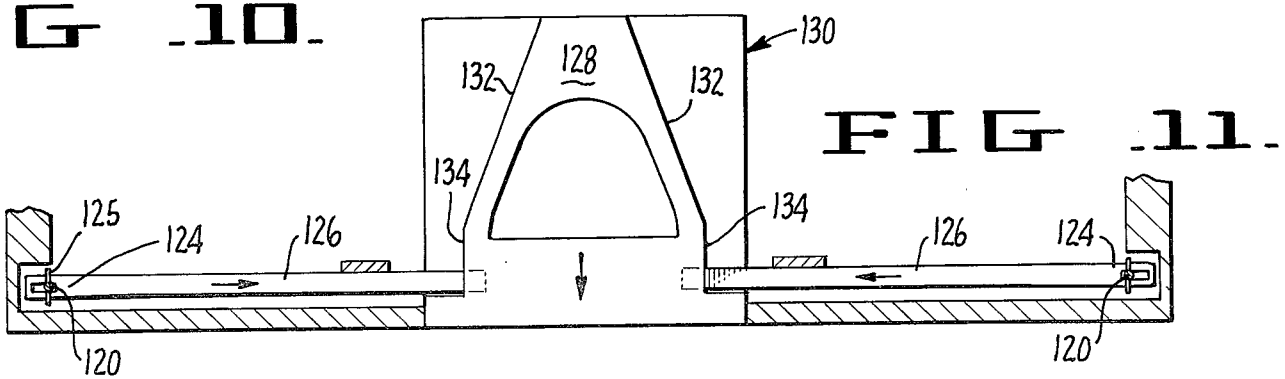
FIG. 11 is a plan view in the line 11—11 of FIG. 10.

The transparent cover 14 is surrounded by a frame 110 of a relatively heavy plastic. As can be seen in FIG. 3, the rear of the frame 110 fits under a lip 112 formed on the base member 12. The front of the frame 110 is slotted at 114 to accomodate the front 26 of the slide member. The frame 110 is provided with downwardly extending catches 116 which engage complementary catches 118 mounted on the base 12. The pins 120 normally extend upwardly into mating holes in frame 110. Thus, the frame cannot move to the rear since it rests on 112, cannot mvoe upwardy because of the coaction of catches 116 and 118, and cannot be moved forward because of the pins 120. The pins 120 are urged downwardly by springs 122 and are held in the upward position by means of cam surfaces 124 which act against retainer 125 on pin 120. Cams 124 are actuated by the rods 126, each of which has a downwardly extending cam follower member 127. These slide against a cam member 128 mounted upon the coin box 130. Member 128 has angling surfaces 132 which bear against the cams 127. These angling surfaces 132 lead to flat surfaces 134 and, as can be seen best in FIG. 11, when the coin box is in its inserted position, the flat surfaces 134 force outwardly upon the rods 126 causing the cams 124 to hold the pins 120 in engagement with frame 110 against the action of springs 122. Now, as one withdraws the coin box as is shown by the direction of the center arrow in FIG. 11, the cams 127 ride down on the angling portions 132, releasing cams 124 which allows the springs 122 to retract pins 120. One cannot only empty the coin box, but also remove the entire cover assembly by sliding it forward to disengage the catches 116 and 118, whereupon the entire cover can be lifted off for refilling the vending machine with merchandise. After the machine has been filled, cover 116 is put into place and the coin box reinserted which will again cause the cams 124 to hold the pins 120 in place so that the cover is secure. Thus, a single lock protects both the coin box and the merchandise. Of course, a double lock may be provided so that one key would unlock the coin box and another would unlock the cover.

It is believed apparent from the foregoing that I have provided an improved vending machine which is particularly adapted for use in vending newspapers and the like, wherein the contents are fully visible, yet protected from the elements. The entire cover can be lifted off for servicing the machine merely by removing the coin box. The improved slide mechanism of the invention makes it substantially impossible to steal a paper either by pulling out on a paper which has been partially dispensed or by jiggling the slide mechanism.

I claim:

1. A newspaper vending machine or the like, comprising in combination:

a. a base member with catches;

b. a generally horizontal surface formed on said base member adapted to hold a plurality of flat articles;

c. a transparent cover for said plurality of flat articles, said transparent cover having a transparent front, sides a top and catches engaging said catches on said base;

d. a pair of locking pins slidably mounted in each side of said cover, said pins having biasing means normally biasing said pins to extend downwardly into mating holes in said base member preventing lateral movement of said cover with respect to said base;

e. a coinbox slidably mounted in said base, said coin box having cam surfaces on each side thereof;

f. a pair of slidably mounted transverse rods having cam followers thereon on the inside ends thereof, said cam followers pressing on the cams on the sides of the coin box, said transverse rods having cam surfaces on the opposite ends acting on said pins whereby when said coin box is inserted in said base, said transverse rods are retracted away from said box, causing said pins to lock said cover onto said base and wherein said cam surfaces on said coinbox are actuated by said coin box to withdraw said pins from said base when said coin box is withdrawn, thereby g. permitting said transparent cover to be lifted completely off of said base.

2. In the newspaper vending machine of claim 1, a sliding dispensing mechanism adapted to dispense the bottommost article from a stack of articles on said horizontal surface, comprising in combination:

a. a pair of fixed side members, said members having a planar top surface and being spaced apart and having external dimensions approximating the dimension of an article to be dispensed, b. a slotted slide member having a planar top surface mounted between said side members and having support means for supporting said member in sliding relationship whereby the planar tops of said side members and said slide member are maintained on a common plane, c. a retraction member mounted under said slide member, said retraction member having upwardly directed points corresponding in number and placement to said slots and adapted to move in and out of said slots of the slide member whereby said points can be brought to a level above the top of the slide member or retracted to a position below the level of the slide member, d. said slide member having downward turned walls having slots therein, said slots having a generally vertical portion sloping toward the rear of the slide and terminating in a horizontal section, e. said side members having downturned inward facing edges with elongated slots therein, said slots having a flat top portion and a downwardly extending angular extension sloping toward the front of the machine, and f. support pins attached to said retraction member, passing through the slots in the slide member.

3. The structure of claim 2 wherein said slide member support means includes out-turned lips mating with complementary grooves on said side members whereby said side members support said slide member in sliding relationship.

4. The structure of claim 2 wherein the retraction member has teeth extending downwardly therefrom which can engage movable rods extending from side-to-side under said retraction member.

5. The structure of claim 4 wherein said movable rods fit in the slots in said side members, said slots extending downwardly from the front of said machine and means biasing said rods toward the front of said machine.

* * * * *